United States Patent [19]

Ingram

[11] Patent Number: 4,491,078

[45] Date of Patent: Jan. 1, 1985

[54] TUFTING MACHINE HOOK AND KNIFE MOUNTING APPARATUS

[75] Inventor: Gray L. Ingram, Ooltewah, Tenn.

[73] Assignee: Spencer Wright Industries, Inc., Chattanooga, Tenn.

[21] Appl. No.: 524,150

[22] Filed: Aug. 18, 1983

[51] Int. Cl.[3] ..... D05C 15/00

[52] U.S. Cl. ..... 112/79 R

[58] Field of Search ..... 112/79 R

[56] References Cited

U.S. PATENT DOCUMENTS

| | | | |
|---|---|---|---|
| 4,195,580 | 4/1980 | Hurst | 112/79 R |
| 4,207,825 | 6/1980 | Bleasdale | 112/79 R |
| 4,217,837 | 8/1980 | Beasley et al. | 112/79 R |
| 4,354,441 | 10/1982 | Hurst | 112/79 R |
| 4,445,446 | 5/1984 | Beasley et al. | 112/79 R |
| 4,448,137 | 5/1984 | Curtis et al. | 112/79 R |

*Primary Examiner*—Ronald Feldbaum

*Attorney, Agent, or Firm*—Alan Ruderman

[57] ABSTRACT

Gauge parts mounting blocks for the hooks and knives of a tufting machine have at least a pair of reference surfaces for acurate installation in the tufting machine while providing a mounting construction which allows individual gauge parts to be changed. Each block is an elongated member having gauge parts receiving slots spaced in the direction of elongation for receiving an attaching portion of a respective gauge part in side-by-side relationship. The slots open into a hollow which extends longitudinally through the member. Clamping inserts are received within the hollow and act against the attaching portion of the gauge parts. In the hook mounting block the upper surface of the hollow forms a reference surface against which the shanks are clamped. In the knife mounting block a centrally disposed web connects a pair of flanges having knife receiving grooves, and the reference surfaces are inclined relative to the web to form the required angle of inclination and angle of canter that the knives must make for proper cutting action.

19 Claims, 6 Drawing Figures

TUFTING MACHINE HOOK AND KNIFE MOUNTING APPARATUS

BACKGROUND OF THE INVENTION

This invention relates to tufting machine gauge parts, and more particularly to gauge part mounting blocks for mounting the hooks and knives in a tufting machine.

In the production of tufted pile fabric each reciprocating needle cooperates with a looper or hook which seizes a loop of yarn from the needle and releases the loop to form loop pile fabric or holds the loop until it is cut by a knife acting in scissors-like fashion against the side of the hook to form cut pile fabric. The gauge of the pile fabric is determined by the spacing between adjacent gauge parts, i.e., the needles, hooks and knives, of the tufting machine. In conventional tufting machines the loopers or hooks are mounted within corresponding slots cut in a looper or hook bar and secured therein by set screws threaded into the slot and into abutment with the shank of the looper or hook. The screw acts to force a reference surface of the looper or hook against the solid portion of the bar at the closed end of the slot. Such constructions are well known and extensively disclosed in the prior art and may best be illustrated in U.S. Pat. Nos. 3,064,600 and 3,595,184. This conventional mounting of the hooks creates difficulties in aligning closely spaced hooks and minimizing deflection thereof. Moreover, since the securing set screws are within the slots they have a minimal amount of hook bar material into which they are threaded thereby creating a weakness in the securing of the hooks to the bar. The end of the screw that engages the hook further places a burr on the cooperating edge of the hook which makes it difficult to remove the hook from the slot when replacement is required.

More recently, in tufting machines in which the gauge, i.e., the spacing between adjacent gauge parts, is less than 0.1 inch, modules in which the hook shanks are embedded by molding in a common modular body member in side-by-side disposition have been utilized with great success. Such construction substantially eliminates the difficulties of aligning hooks in the hook bar of the tufting machine since the hooks are aligned in a jig during the formation of the module and each body member has at least one alignment surface for clamping the module to the hook bar. One difficulty with this construction is that when one hook is worn or broken the entire module must be removed and, although procedures have been developed for extracting and replacing a worn hook, the module including the good hooks generally are discarded or returned for remanufacture. For fine gauge machines, such as 1/16 of an inch and smaller this problem is justified by the advantages provided by the modules, not the least of which is the precision of aligning the hooks and the reduced deflection of the hooks due to the pressure of the respective knives acting against a face thereof. However, for courser gauges, this justification is reduced.

Additionally, in conventional cut pile tufting machines the knives are mounted in knife blocks which in turn are mounted in a knife bar. The conventional knife blocks have two or more elongated channels within which the knives are mounted, and the block includes a cylindrical spigot extending from the body thereof for insertion within a bore formed in the knife bar as illustrated for example, in U.S. Pat. No. 3,084,645. Since the knives must act against the face of the respective hooks in scissors-like fashion with sufficient pressure, the knife block is pivoted within the bore to engage the face of the hook at an angle of inclination generally approximately 8° and contact the hook at an angle of canter generally approximating 4°. This latter angle is provided by cutting the bore in the knife bar at the canter angle. The combination of the angle of inclination and the angle of canter provides a compound angle to the knives relative to the hooks. Although the canter angle is effectively fixed by the angle of the bore, the angle of inclination of the block can become misaligned or can be incorrectly adjusted when the tufting machine is assembled or when a knife or knife block is replaced. Moreover, although the use of screws acting directly on the edges of each knife to secure the knives in the channels has been discarded for saddles such as that illustrated in U.S. Pat. No. 4,211,176, and other clamping members such as illustrated in U.S. Pat. No. 4,289,082, many problems still exist in relation to securing the knives within the channels.

To eliminate these deficiencies in fine gauge tufting machines the knives are embedded by molding within modular body members having alignment surfaces in a manner similar to that of the modular hooks. Thus, the correct compound angle is fixed and the knives are secured in their proper relationship. Although this is advantageous to all tufting machines, the same difficulty as that of the hook modules is presented, that is, an entire module must be replaced when a single knife is worn or broken. Again, for fine gauge tufting machines this modular construction is justified since space is a minimum, but for courser gauge machines the disadvantage of not being able to remove a single knife is undesirable.

SUMMARY OF THE INVENTION

Consequently, it is a primary object of the present invention to provide hook and knife gauge parts mounting means in which the respective gauge parts may be readily secured in proper relationship to each other in fixed angular relationship while permitting individual gauge parts to be readily replaced as necessary.

It is another object of the present invention to provide gauge parts mounting blocks for the hooks and knives of a tufting machine which permit removal of the gauge parts from the blocks, the body of the hooks at least being supported over a larger portion thereof to eliminate deflection difficulties and the knives being supported to eliminate angular adjustment problems.

It is a further object of the present invention to provide a hook mounting block for a tufting machine for receiving a plurality of hooks, the hooks and blocks having corresponding reference surfaces for acurately positioning the hooks in the block and securing members acting on a substantial portion of the shanks of the hooks.

It is a still further object of the present invention to provide a hook mounting block for a tufting machine for supporting a plurality of hooks, the block having a bore extending the length thereof and a plurality of hook receiving slots opening at opposite sides of the block into the bore, the bore receiving a plurality of inserts acting against the shanks of the hooks for forcing a reference surface of the shank against a cooperating reference surface of the block intermediate the slots, and means for securing the inserts in the bore and for forcing the inserts against the respective shanks.

It is a yet still further object of the present invention to provide a knife mounting block for a tufting machine for receiving a plurality of knives in knife receiving channels the block being formed with reference surfaces such that when mounted in the tufting machine the knives are disposed at a desired fixed compound angle relative to the hooks.

It is a still yet further object of the present invention to provide a knife mounting block for a tufting machine for carrying a plurality of knives in channels formed in the block, the block having reference surfaces for attaching to a knife bar within the tufting machine, one reference surface providing the correct angle of inclination and the other reference surface providing the correct angle of canter to the knives, the block having a hollow opening into the channels and receiving inserts for securing the knives in the channels Accordingly, the present invention provides tufting machine gauge parts mounting blocks in which the hooks and knives may be acurately mounted within the tufting machine eliminating adjustability of the gauge parts and thus minimizing improper settings of the gauge parts, thereby providing a major advantage of the molded modular gauge parts mounting blocks yet providing the advantage of removability of the individual gauge parts. The mounting blocks have at least a pair of reference surfaces for mating with cooperating surfaces of the respective hook mounting bar and knife mounting bar of the tufting machine so that the blocks are readily and acurately installed in the tufting machine, each reference surface being disposed at the proper angle for loop seizing and loop cutting. The reference surfaces of the knife block are angularly disposed so that the correct angles of inclination and canter are provided for effective and uniform cutting action.

The hook block comprises a body member through which an elongated hollow bore extends the entire length of the block and includes a plurality of slots extending transverse to the axis of the bore at the forward and rearward faces of the block, the slots at the forward face being aligned with those at the rear face and each slot opening into the bore. The shanks of corresponding hooks are inserted into the forward slot and extend into the rearward slot, while the rear of the neck of each hook, which is a hook reference surface, engages the reference surface provided by the end of the respective forward slot. The bore is enlarged for receiving clamping inserts which are forced by securing means to act against the lower edge of the hook shanks to force and clamp the upper edge of the hook shanks, which is another reference surface, against a corresponding reference surface at the upper surface of the hollow bore. The hook block has at least two reference surfaces for coacting with the hook bar beneath the bore and can be readily secured to the hook bar without interfering with the knife portion of the cutting system.

The knife mounting block has at least a pair, and preferably two pair, of knife receiving channels on opposite sides of a substantially central web and a hollow bore extending through the body of the block transversely to the channels and opening into the channels for receiving clamping inserts which are forced by securing means against an edge of the respective knives to secure the knives within the channels. At the side opposite to the bore relative to the channels, the body of the knife block is formed with a pair of reference surfaces, the surfaces respectively forming the angle of inclination and the angle of canter that the knives must make with the hooks. These reference surfaces cooperate with surfaces of the knife bar and the block has simple clamping means for securing the blocks to the knife bar.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
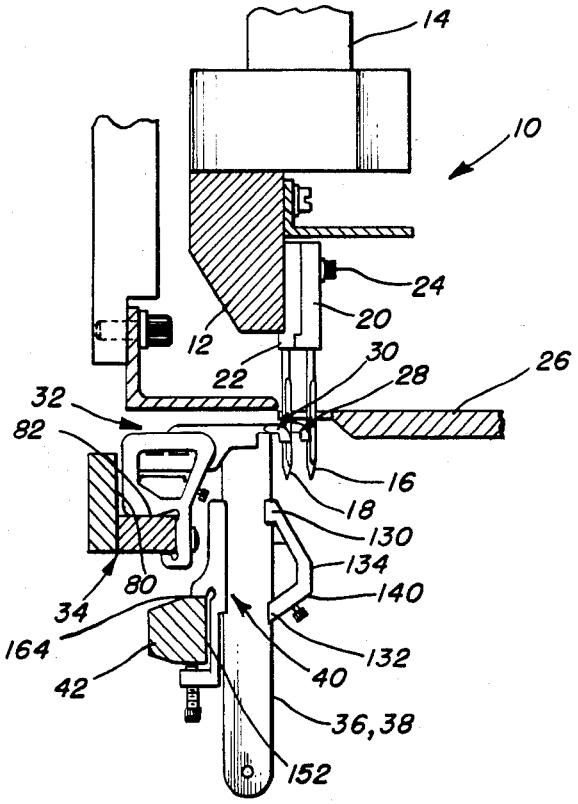
FIG. 1 is a vertical cross sectional view taken transversely through a cut pile tufting machine incorporating hooks and knives mounted in mounting blocks constructed in accordance with the principles of the present invention.

Referring now to the drawings, and particularly to FIG. 1, the relevant portions of a tufting machine 10 are illustrated as including a needle bar 12 supported at the end of one or more push rods 14 driven axially reciprocably in conventional manner. Carried by the needle bar 12 arranged in rows disposed one behind the other and off-set or staggered in the longitudinal direction of the needle bar is a plurality of needles 16, 18 (only two of which are illustrated). The needles 16, 18 may be arranged in modular units as illustrated, the needles 16 being carried in a first body member 20 and the needles 18 carried in a second body member 22, the two body members having cooperating locating surfaces and being secured to the needle bar by a common screw 24.

Mounted in the bed of the tufting machine beneath the bed plate 26 is a plurality of front hooks 28 and a plurality of rear hooks 30, the hooks 28 cooperating with the needles 16, and the hooks 30 cooperating with the needles 18 to seize the loops of yarn presented by the respective needles. The hooks are mounted in a hook mounting block generally indicated at 32 as hereinafter described, and the mounting block 32 is secured to a hook bar 34 oscillated in conventional manner so that the hooks cooperate with the needles as aforesaid. The hooks 28, 30 also cooperate with respective knives 36 and 38 mounted in knife blocks 40 as hereinafter described, the knives and hook throats being illustrated as aligned for ease of presentation. The knife blocks 40 are secured to a knife bar 42 oscillated in timed relationship with the oscillation of the hooks for coacting with a face of the respective hooks in scissors-like manner for cutting the loops of yarn on the hooks to form cut pile.

Each hook 28, 30 includes a substantially flat shank 44, 46 respectively having a substantially rectangular configuration and a respective blade 48, 50 extending forwardly from the shank in the plane thereof to define a respective throat 52, 54 at the forward end of where the shank and blade join, and a respective neck 56, 58 at the rear end of the junction of the shank and blade. Bills 60, 62 are disposed at the leading free ends of the blades for cooperation with the respective needles for seizing loops of yarn presented by the needles. On the upper edge of each shank 44, 46 stepped from the respective bill 48, 50 is a respective pair of machined surfaces 64 and 66. The surfaces 64 and 66 together with the respective necks 56 and 58 define reference surfaces for each of the hooks 28, 30 for positioning within the hook mounting block 32.

Figure 2:
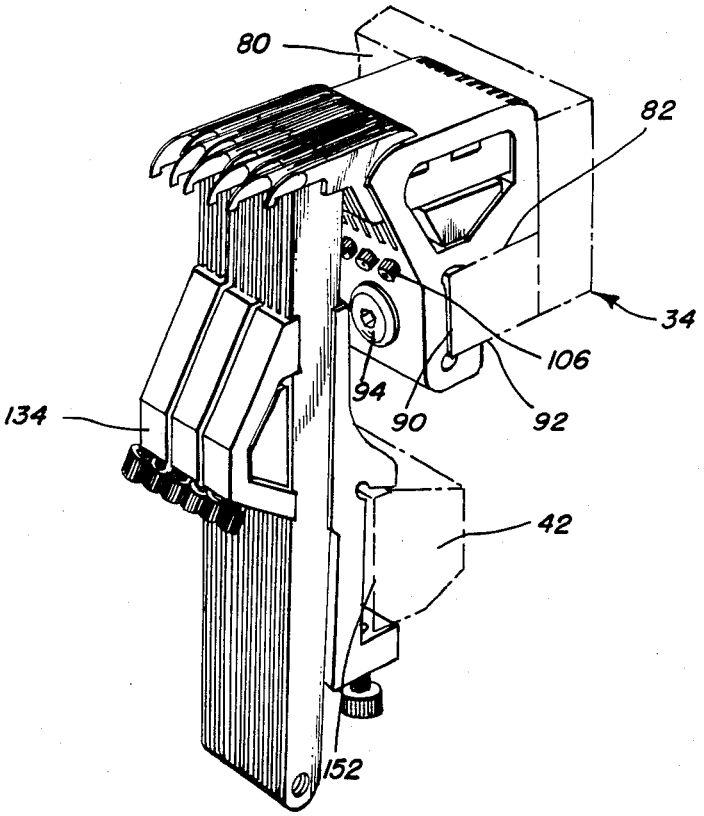
FIG. 2 is a perspective view of a hook mounting block and three knife mounting blocks, the knives and hooks substantially corresponding in number.
Figure 3:
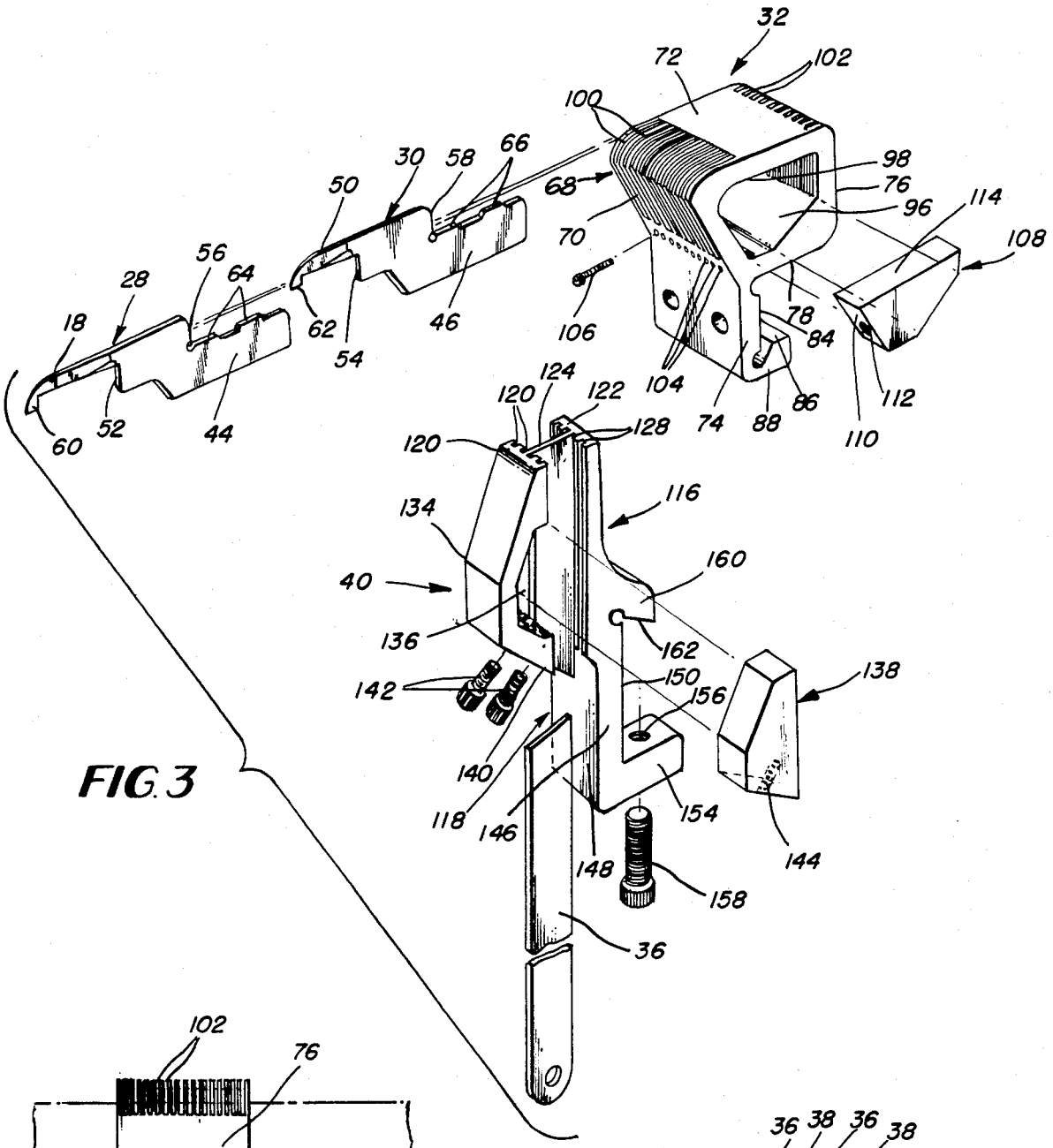
FIG. 3 is a disassembled perspective of the hook and knife mounting blocks illustrated in FIG. 2.
Figure 4:
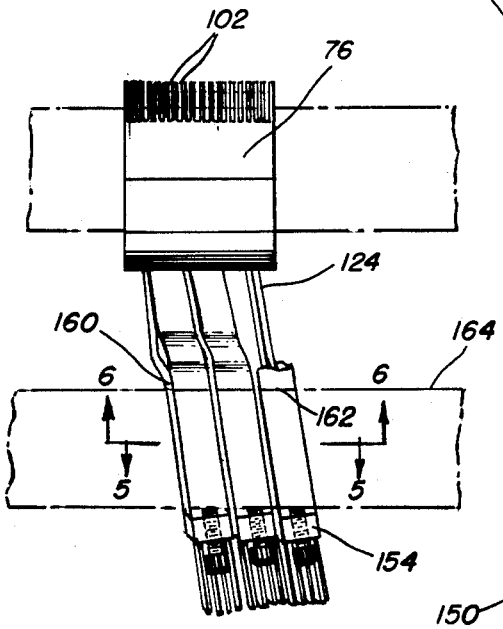
FIG. 4 is a rear elevational view of the knife and hook mounting blocks in their operative positions.
Figure 6:
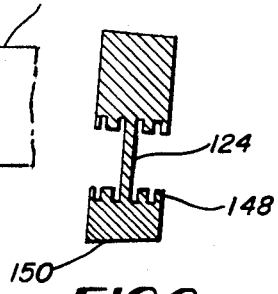
FIG. 6 is a cross sectional view taken substantially along line 6—6 of FIG. 4.
Figure 5:
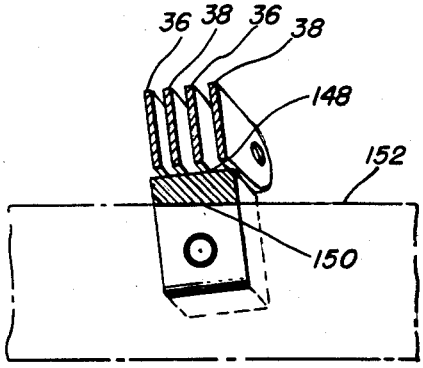
FIG. 5 is a cross sectional view taken substantially along line 5—5 of FIG. 4.

As best illustrated in FIGS. 2 and 3, each mounting block 32 comprises an elongated body member including an upper hook carrying portion 68 having a substantially rectangular configuration, but preferably with the front surface 70 tapered downwardly, for providing extended support for the hooks and for clearance purposes, from the upper surface 72 to join a downwardly extending wall 74 forming a lower or securing portion. The rear surface 76 of the upper portion 68 and the bottom surface 78 thereof are substantially planar reference surfaces which respectively mate with respective cooperating surfaces 80, 82 of the hook bar 34, which preferably are normal to each other. The surface 78 is a reference surface for accurately positioning the block. Moreover, the rear surface 84 of the securing portion 74, and also preferably a surface 86 formed on the top of a leg 88 extending rearwardly from the wall 74 form accurate reference surfaces which mate with respective cooperating front and bottom surfaces 90, 92 of the hook bar. The surface 86 may be substantially normal to the surface 84 and parallel to the surface 78 and the block snugly fits about the hook bar. Thus, the mounting block 32 has a datum position defined by the reference surfaces within the tufting machine. One or more securing screws 94 extending through the securing portion 74 act to secure each block 32 to the hook bar.

Each hook mounting block 32 includes a central aperture or hollow 96, the upper section of which being of a substantially rectangular form and the lower section being trapezoidal. In the preferred form the block 32 is formed from aluminum extruded into the desired configuration including the hollow 96 and the surface 98 of the upper wall of the hollow is a substantially planar reference surface. The front and rear walls of the block which include the surfaces 70 and 76 have a plurality of slots 100, 102 respectively, the slots 100 being aligned with corresponding slots 102 and cut substantially normal to the axis of elongation of the block. Each of the slots 100, 102 extend from the respective surface 70, 76 and open into the interior of the hollow 96, but are spaced apart so that a substantial amount of solid material remains at the wall between the surfaces 72 and 98. The rear terminus of each slot 100 provides another reference surface for accurately positioning the hooks which are inserted shank end first into the slots 100 with the ends of the shanks entering the slots 102 and guided thereby. The hooks 28, 30 are inserted into the slots 100, 102 until the respective neck 56, 58 engages the rear terminus of the slots 102 and about the upper wall of the block 32.

Extending through the wall forming the front surface 70 at disposition adjacent the wall 74 and opening into the aperture 96 is a plurality of holes 104 preferably tapped for threadedly receiving screws 106. Preferably there is one hole 104 corresponding to each pair of slots 100, 102. Disposed within the aperture 96 are a plurality of clamping inserts 108 each having a trapezoidal shape substantially corresponding to the shape of the lower section of the aperture 96. The front face 110 of each insert 108 includes a bore 112 for receiving a respective screw 106 which holds the insert in the aperture. The upper surface 114 of the insert when positioned within the aperture 96 acts against the lower edges of the shanks of two hooks and when the screws 106 are tightened and enter further into the bores 112 of the inserts 108, the respective surfaces 114 force the shanks of hooks positioned within the slots 100, 102 upwardly until the reference surfaces 64, 66 of the respective hooks 28, 30 engage the reference surface 98 within the hollow 96. Further tightening of the screws 106 clamp the hooks 28, 30 within the blocks 32. In the preferred mode of securing the hooks within the block, the inserts 108 are positioned within the aperture 96 and loosely carried by the screws 106. Then, after the hooks are inserted into the slots 100 with the necks 56, 58 abutting the upper wall defining the terminus of the slots 100, the screws 106 are tightened to clamp the inserts against the shanks of the hooks.

The knife blocks 40 comprise a body member having knife mounting means in the upper portion 116 and extending to a lower portion 118 for attaching to the knife bar 42. The upper portion 116 comprises a pair of flanges 120 and 122 connected together by a central web 124 extending substantially normally between the flanges. Coventionally, the knives 36, 38 are received within the knife receiving channels formed by undercutting grooves 126 into the flange 120 and grooves 128 into the flange 122 adjacent each face of the web 124, and at spaced locations therefrom, the number of grooves in each flange being equal and depends upon the number of knives carried by the knife block. The space between adjacent grooves 126 and between adjacent grooves 128 is equal to the gauge of the gauge parts. In the preferred embodiment each knife block carries four knives, alternating knives 36 and 38 cooperating with hooks 28 and 30 respectively so that approximately three knife blocks 40 cooperate with each hook block 32.

Although the flange 122 and the grooves 128 extend a substantial distance from the upper portion 116 to the lower portion 118, the flange 120 and the grooves 126 are formed in two sections, an upper section 130 and a lower section 132, as best illustrated in FIG. 1. The upper and lower sections are spaced apart in the direction in which the knives extend, but are connected together by a bridge member 134 which flares outwardly from the knife channels from each section 130, 132 to define a space or hollow 136 therebetween, the web 124 being undercut in the vicinity of the hollow so that it is narrower than the width of the knives. The hollow 136 extends through the entire knife block and receives at least one and preferably two clamping inserts 138 having a shape corresponding to that of the hollow. A pair of tapped holes are formed in a wall 140 in the lower part of the bridge 134 for receiving a corresponding screw 142, each of which extends through the wall 140 and enters a respective bore 144 which, depending upon its depth and the length of the screw 144, may or may not be tapped so that the screw holds the insert in the hollow. By tightening the screws 142 the respective inserts are forced into contact with the edge of corresponding knives to drive the knives tightly into the grooves 128, the troughs of which act as reference surfaces, and secure the knives within the channels, each insert acting against a pair of adjacent knives.

The lower portion 118 of the knife block 40 comprises an extention of the flange 122 beyond the longitudinal terminus of the grooves 128 to form an elongated knife bar spanning member 146, the knife facing surface 148 being recessed to at least and preferably greater than the depths of the grooves 128 to provide clearance for the knives. The surface of the spanning member 146 opposite the surface 148, that is the surface 150, is machined at a slight angle relative to the plane of the web 124 and the surface 152 of the knife bar 42 against which it is disposed to provide the proper angle of canter for the knives. This angle, as aforesaid, is normally approximately 4°.

Extending from the lower edge of the spanning member 146 is a ledge 154 having a tapped bore 156 into which a screw 158 is threaded. Spaced above the ledge 154 and extending from the rear of the flange 122 is another ledge 160 having a surface 162 facing the ledge 152. The surface 162 projects outwardly from the surface 150 and is inclined relative thereto and relative to the plane of the web 124 in the direction transverse to the knife block so that when the knife block is positioned on the upper surface 164 of the knife bar 42 the blocks and thus the knives 36, 38 are inclined relative to the knife bar and cooperating hooks 28, 30, the angle of inclination as aforesaid normally being approximately 8°.

Thus, the surfaces 150 and 162 provide reference surfaces which cooperate with respective reference surfaces 152 and 164 of the knife bar 42 to provide the desired compound angle for effective cutting action between the knives and the cooperating hooks. It should be understood that both the angle of canter and the angle of inclination results in the desired compound angle of the web 124 and thus the knife channels and knives relative to the knife bar 42, the hook bar 32 and thus the plane of the hooks 28, 30. In the prior art this angle was obtained by a spigot or shaft on the knife block disposed in the bore within the knife bar, the bore being cantered relative to the bar and the block being rotated about the spigot, or the knives were molded within a knife block at the proper angle in a jig and thus were not replaceable.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A gauge parts mounting block for a tufting machine oscillatably carrying an elongated gauge parts mounting bar, said mounting block comprising an elongated body member, a plurality of slots formed in and spaced along said body member substantially normal to the axis of elongation thereof, each slot adapted for receiving an attaching portion of a gauge part so that a plurality of said gauge parts may be mounted in side-by-side relationship in the body member, a hollow extending longitudinally through said body member the entire length thereof, part of the attaching portion of each of said gauge parts being disposed within said hollow when said attaching portions are disposed in said slots, a plurality of clamping inserts disposed in said hollow for engagement with said attaching portions, a reference surface formed in said body member remote from the disposition of said inserts, securing means for holding said inserts in said hollow remote from said reference surface and for moving said inserts into abutment with an edge of the attaching portion of the gauge parts disposed in said hollow to force an opposite edge of said portion into abutting engagement with said reference surface, said body member having a pair of mounting reference surfaces elongated in the direction of said block for mating with corresponding surfaces of the mounting bar, and means for securing said block to said mounting bar.

2. A hook mounting block for mounting a plurality of tufting machine hooks, each hook comprising a substantially planar member including a blade having a bill at one end and a mounting shank extending from an opposite end, said blade and shank being joined at a neck, and said shank having a reference edge extending substantially normal to said neck, said block comprising an elongated body member, a hollow extending longitudinally through said body member the entire length thereof, a plurality of slots formed in and spaced along said body member substantially normal to the axis of elongation thereof, said slots terminating at a closed end in a first wall of said hollow such that the slots open into the hollow, the surface of said wall within said hollow being defined as a reference surface, each slot adapted to receive the shank of a hook with the neck abutting said wall at the closed end of the slot such that a plurality of said hooks may be mounted in side-by-side relationship in the body member with the necks of said hooks substantially aligned along said block, a plurality of clamping inserts disposed in said hollow, each insert being disposed for engagement with the shank of at least one hook at a second edge spaced from said reference edge, securing means for holding said inserts in said hollow, and for moving said inserts into abutment with said second edge to force said reference edge into abutment with said reference surface, and at least a pair of elongated mounting reference surfaces on said body member adapted for mating with corresponding mounting surfaces of a tufting machine.

3. A hook mounting block as recited in claim 2, including a second plurality of slots formed in said body member spaced from the first mentioned plurality of slots across said hollow and opening into said hollow, each slot of said second plurality of slots corresponding to and aligned with a slot of said first mentioned slots for receiving the ends of the shanks of the hooks disposed in said first mentioned slots.

4. A hook mounting block as recited in claim 2, wherein said body member comprises a hook carrying portion having a generally rectangular configuration including a first surface on the exterior of said wall, and a second surface extending from the first surface in tapered fashion downwardly and inwardly relative to said hollow, said second surface joining a downwardly extending attaching portion for attaching to the tufting machine, said slots being formed through the juncture of said first and second surfaces.

5. A hook mounting block as recited in claim 4, including a second plurality of slots formed in said body member spaced from the first mentioned plurality of slots across said hollow and opening into said hollow, each slot of said second plurality of slots corresponding to and aligned with a slot of said first mentioned slots for receiving the ends of the shanks of the hooks disposed in said first mentioned slots.

6. A hook mounting block as recited in claim 5, wherein said securing means comprises screw means threadedly extending through said second surface and into said hollow, and a bore in each insert for receiving said screw means.

7. A hook mounting block as recited in claim 6, wherein said inserts have a trapezoidal configuration.

8. A hook mounting block as recited in claim 4, wherein said mounting reference surfaces comprise a third surface on the exterior of a second wall of said hollow opposite to said first wall, and at least a portion of a first surface of said attaching portion joining said third surface.

9. A hook mounting block as recited in claim 8, including a second plurality of slots formed in said body member spaced from the first mentioned plurality of slots across said hollow and opening into said hollow, each slot of said second plurality of slots corresponding to and aligned with a slot of said first mentioned slots for receiving the ends of the shanks of the hooks disposed in said first mentioned slots.

10. A hook mounting block as recited in claim 9, said mounting reference surfaces include a second surface of said attaching portion, said second surface being subtantially normal to said first surface of said attaching portion and substantially parallel to said third surface.

11. A knife mounting block for mounting a plurality of machine knives, each knife comprising a substantially rectangular planar member having a pair of opposed edges, said block comprising an elongated body member having a pair of spaced flanges connected together by a substantially centrally disposed planar web, a hollow extending through said web and longitudinally of said body member the entire length thereof, at least one knife receiving channel disposed on each side of said web, said channels being spaced apart in the longitudinal direction of said body member so that a plurality of knives may be mounted in spaced side-by-side relationship among said body member, each channel being defined by a pair of facing grooves formed in said flanges for receiving the opposed edges of a knife, each channel opening into said hollow such that one of said opposed edges of a knife received in each channel will be disposed within said hollow, a plurality of clamping inserts disposed in said hollow adjacent a first of said flanges, each insert being disposed for engagement with said one of the opposed edges of at least one knife, securing means for holding said inserts in said hollow and for moving said inserts into abutment with said one edge of the knife to force the opposite edge of said knife into abutment with the second flange, and a pair of elongated mounting reference surfaces on said body member adapted for mating with corresponding mounting surfaces of a tufting machine.

12. A knife mounting block as recited in claim 11, wherein each of said reference surfaces is angularly disposed relative to the plane of said web, and said channels are parallel to said web, one of said surfaces defining the inclination of the knife and the other surface defining the camber of the knife when disposed in the tufting machine.

13. A knife mounting block as recited in claim 11, wherein said reference surfaces are disposed on a portion of said second flange remote from said channels.

14. A knife mounting block as recited in claim 13, wherein each of said reference surfaces is angularly disposed relative to the plane of said web, and said channels are parallel to said web, one of said surfaces defining the inclination of the knife and other surfaces defining the camber of the knife when disposed in the tufting machine.

15. A knife mounting block as recited in claim 14, including clamping means for securing said block to the mounting surface of a tufting machine, said clamping means including a ledge extending from one of said reference surfaces and spaced from the other reference surface.

16. A knife mounting block as recited in claim 11, wherein said first flange comprises first and second spaced portions and a bridging portion integral with and interconnecting said first and second portions, said first and second portions having grooves for receiving said one edge of each knife, said bridging portion extending outwardly from said first and second portions relative to said second flange to form said hollow between the bridging portion and the first and second portions.

17. A knife mounting block as recited in claim 16, wherein each of said reference surfaces is angularly disposed relative to the plane of said web, and said channels are parallel to said web, one of said surfaces defining the inclination of the knife and the other surfaces defining the camber of the knife when disposed in the tufting machine.

18. A knife mounting block as recited in claim 17, wherein there are two channels on each side of said web, and each insert acts against said one edge of both knives on one side of said web.

19. A knife mounting block as recited in claim 18, including clamping means for securing said block to the mounting surface of a tufting machine, said clamping means including a ledge extending from one of said reference surfaces and spaced from the other reference surface.

* * * * *